US007421931B2

(12) United States Patent
Hu

(10) Patent No.: US 7,421,931 B2
(45) Date of Patent: Sep. 9, 2008

(54) SOCKET WRENCH/ADAPTOR COMBINATION

(76) Inventor: Bobby Hu, 16F-2, No. 367, Gong Yi Road, West District, Taichung (TW)

( * ) Notice: Subject to any disclaimer, the term of this patent is extended or adjusted under 35 U.S.C. 154(b) by 16 days.

(21) Appl. No.: 11/622,122

(22) Filed: Jan. 11, 2007

(65) Prior Publication Data

US 2008/0134844 A1 Jun. 12, 2008

(30) Foreign Application Priority Data

Dec. 12, 2006 (TW) ..... 95146475 A

(51) Int. Cl.
*B25B 23/16* (2006.01)
*B25G 1/08* (2006.01)

(52) U.S. Cl. ..... 81/177.85; 81/177.4; 81/490

(58) Field of Classification Search ..... 81/177.4, 81/177.85, 180.1, 184, 185, 490, 60–63.2
See application file for complete search history.

(56) References Cited

U.S. PATENT DOCUMENTS 5,148,724 A * 9/1992 Rexford ..... 81/60
5,522,287 A 6/1996 Chiang
5,943,924 A * 8/1999 Jarvis ..... 81/177.2
6,161,454 A 12/2000 Chaconas
6,263,766 B1 * 7/2001 Jarvis ..... 81/60
6,324,947 B2 * 12/2001 Jarvis ..... 81/177.2
6,659,997 B1 * 12/2003 Casutt ..... 606/1
7,171,874 B1 * 2/2007 Huang ..... 81/177.4
7,258,046 B2 * 8/2007 Fruhm et al. ..... 81/177.4

* cited by examiner

*Primary Examiner*—David B Thomas
(74) *Attorney, Agent, or Firm*—Alan Kamrath; Kamrath & Associates PA

(57) ABSTRACT

A combination includes a socket wrench and an adaptor. The socket wrench includes a handle having a head portion. The head portion includes a drive column for driving a socket. The handle includes an open end in which a coupling member is securely mounted. The adaptor is removably engaged with one of the drive column of the head portion and the coupling member. The adaptor includes a coupling portion for releasable engagement with the drive column of the head portion. The adaptor further includes a drive portion having a specification different from that of the drive column. The drive portion can be used to engage with another socket having a size different from that of the socket driven by the drive column.

19 Claims, 6 Drawing Sheets

SOCKET WRENCH/ADAPTOR COMBINATION

BACKGROUND OF THE INVENTION

1. Field of the Invention

The present invention relates to a socket wrench and, more particularly, to a socket wrench having an adaptor removably attached thereto.

2. Description of the Related Art

One type of conventional socket wrench kits includes two socket sets (e.g., a larger socket set consisting of a plurality of larger sockets and a smaller socket set consisting of a plurality of smaller sockets) and two socket wrenches with drive tangs of two sizes for respectively coupling with the socket sets. A typical socket wrench includes a single drive tang for driving sockets, and an example is disclosed in U.S. Pat. No. 6,161,454. The user must carry two or more socket wrenches with drive tangs of different sizes to meet different needs. Another option is to use an adaptor with a drive portion of a different size. The user can couple the adaptor with the drive tang and drive sockets with the drive portion of the adaptor. However, the adaptor is apt to be lost if not received in a toolbox, and finding the adaptor is sometimes a problem when the adaptor is received in a toolbox. The cost is increased by either carrying several socket wrenches or using an adaptor. Furthermore, the overall weight of the toolbox is also increased.

U.S. Pat. No. 5,522,287 discloses a socket wrench including driving plugs respectively on two sides of a handle. The driving plugs have different sizes for driving different socket sets. However, two sets of direction setting devices must be used, leading to difficulty in manufacturing and an increase in the cost. Storage of the socket wrench with two driving plugs on two sides is also a problem.

SUMMARY OF THE INVENTION

A combination in accordance with the present invention includes a socket wrench and an adaptor. The socket wrench includes a handle having a head portion. The head portion includes a drive column adapted for driving a socket. The handle includes an open end in which a coupling member is securely mounted. The adaptor is removably engaged with one of the drive column of the head portion and the coupling member. The adaptor includes a coupling portion for releasable engagement with the drive column of the head portion. The adaptor further includes a drive portion having a specification different from that of the drive column. The drive portion is adapted for engaging with another socket having a size different from that of the socket adapted to be driven by the drive column.

In the most preferred form, the coupling member includes a longitudinal hole and a pair of diametrically disposed resilient tongues. When the adaptor is received in the longitudinal hole of the coupling member, the adaptor imparts outward expanding force to the resilient tongues. Hence, the adaptor is retained in the longitudinal hole of the coupling member by resiliency of the resilient tongues.

The longitudinal hole of the coupling member includes a reduced section through which the drive portion of the adaptor extends. The reduced section includes a plurality of walls each having a recess. The drive portion of the adaptor includes an engaging device. The engaging device is engaged with one of the recesses of the reduced section when the adaptor is received in the coupling member.

The open end of the handle includes an engaging portion which is an annular shoulder on an inner periphery defining a hole in the open end of the handle in the most preferred form. Each resilient tongue includes a hook engaged with the annular shoulder.

Other objectives, advantages, and novel features of the invention will become more apparent from the following detailed description when taken in conjunction with the accompanying drawings.

DETAILED DESCRIPTION OF THE PREFERRED EMBODIMENT

Figure 1:
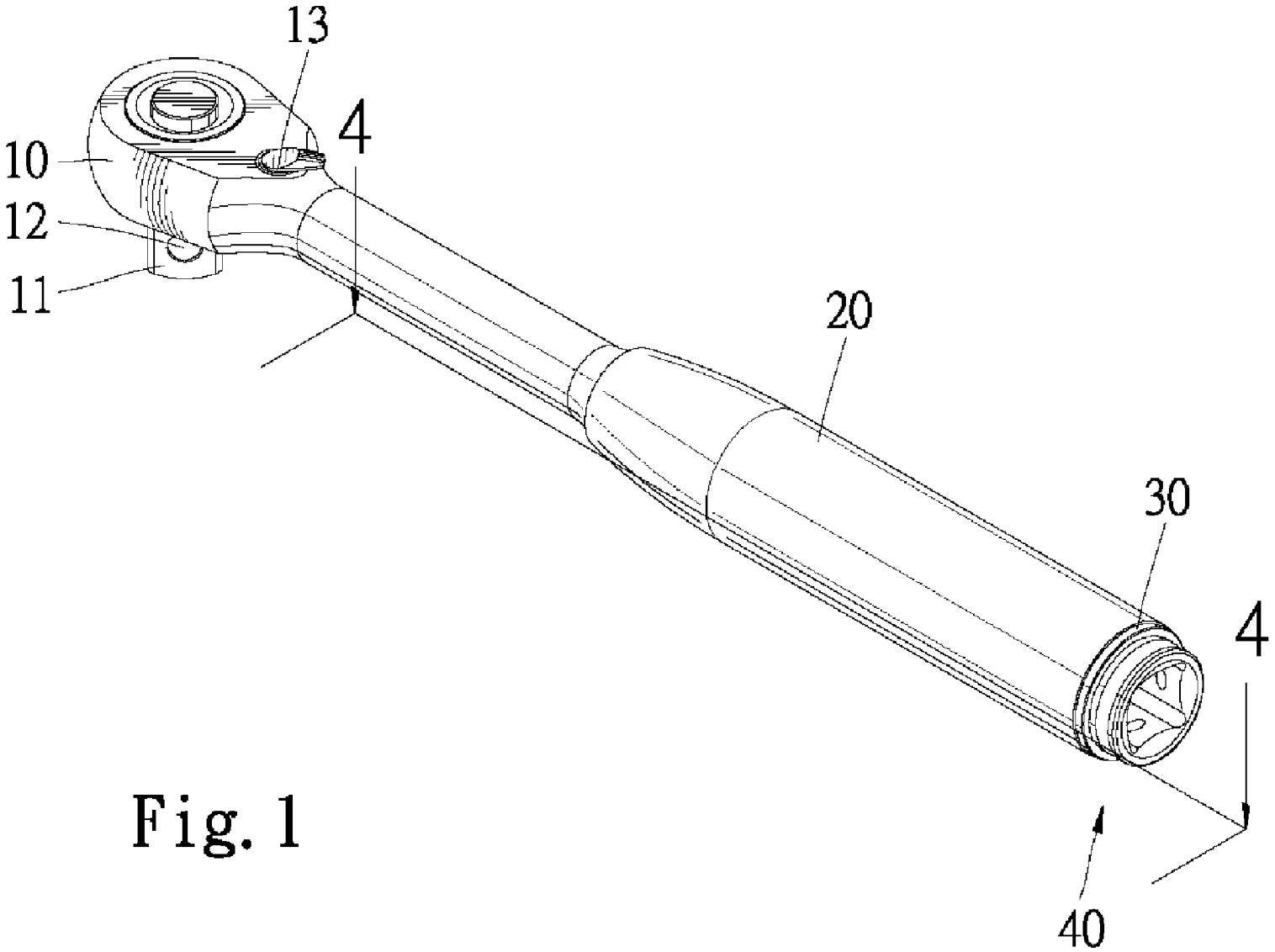
FIG. 1 is a perspective view of a socket wrench/adaptor combination in accordance with the present invention.
Figure 2:
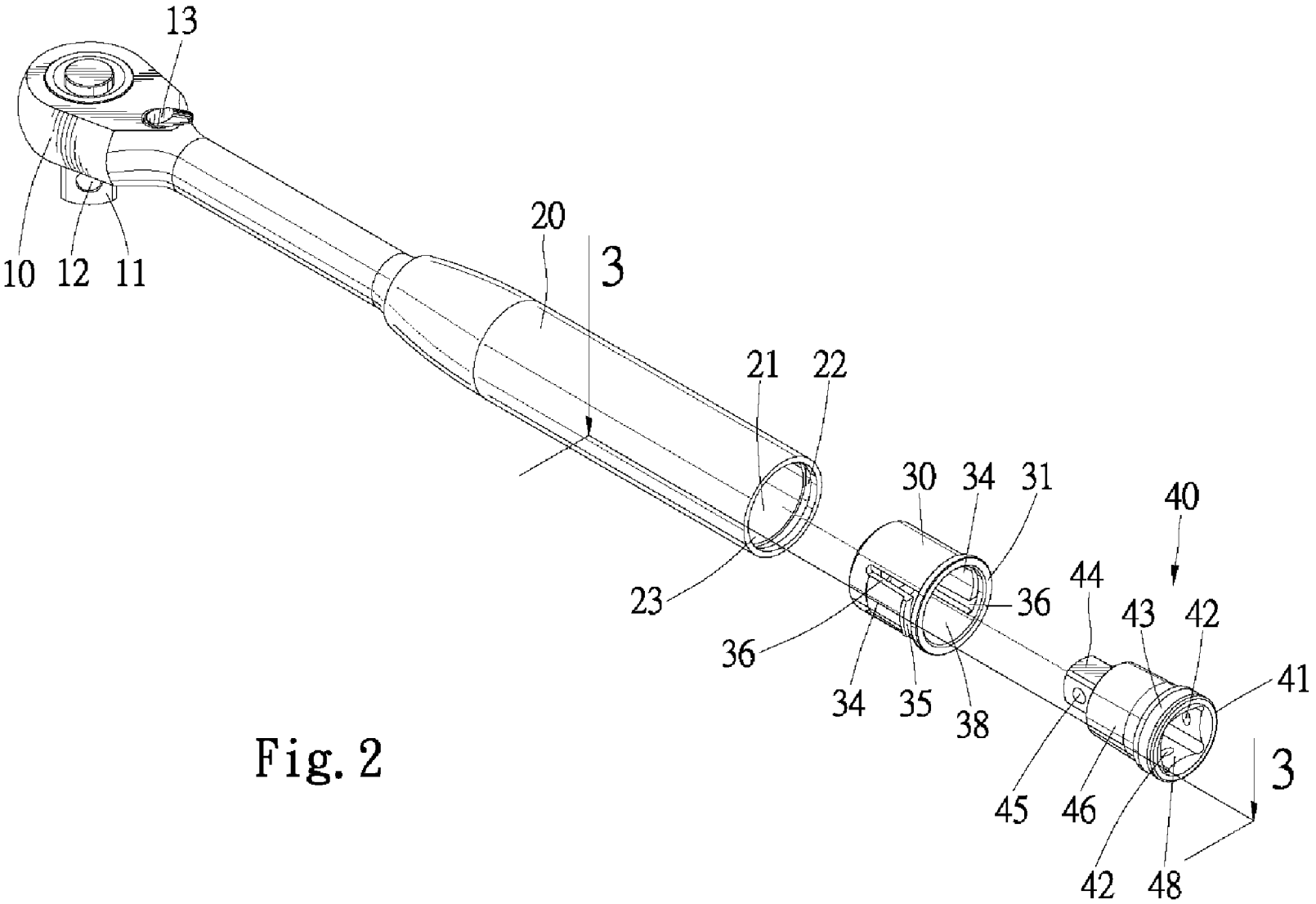
FIG. 2 is an exploded perspective view of the socket wrench/adaptor combination in accordance with the present invention.
Figure 3:
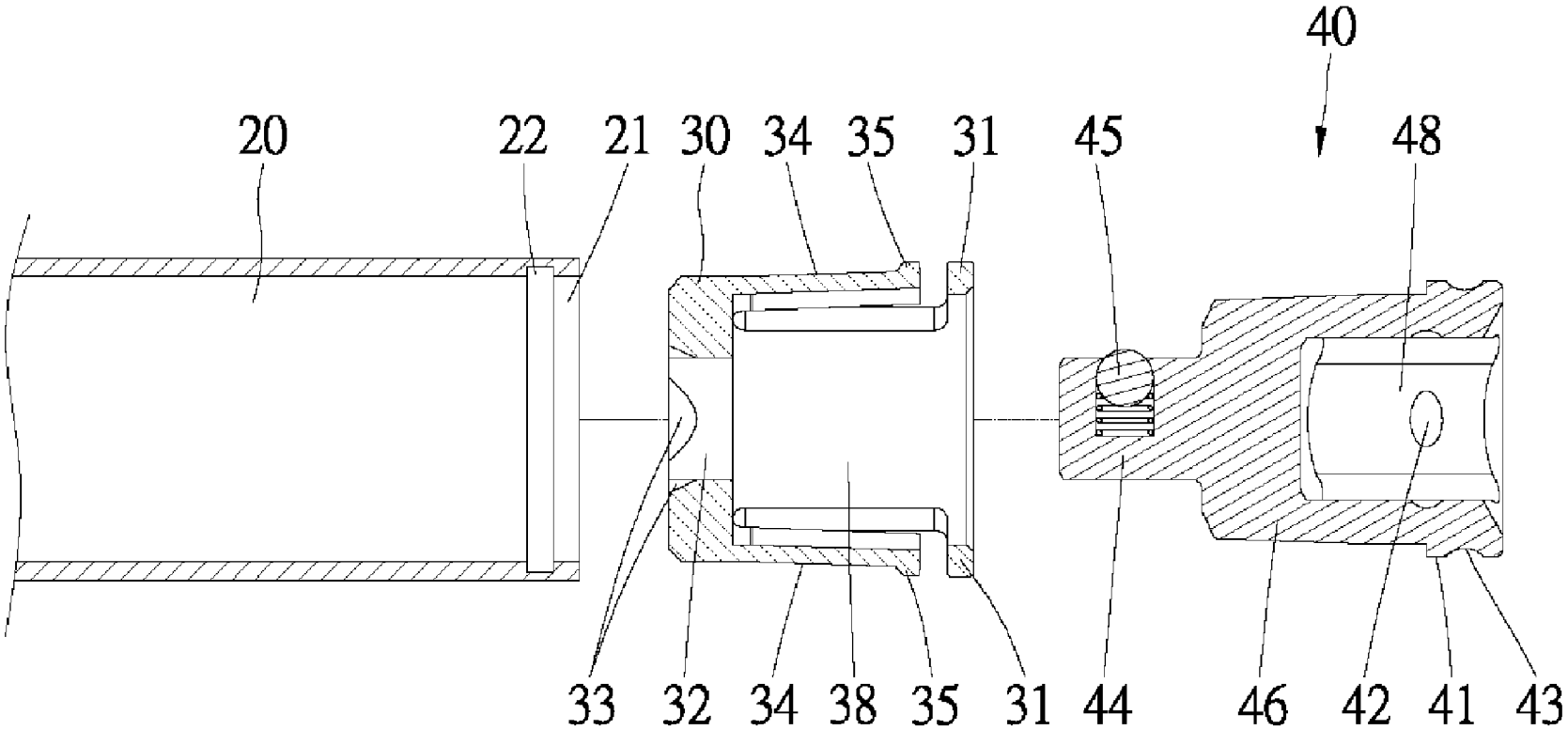
FIG. 3 is an exploded sectional view taken along plane 3-3 in FIG. 2, illustrating a handle, a coupling member, and an adaptor of the socket wrench/adaptor combination in accordance with the present invention.

Referring to FIGS. 1 through 3, a socket wrench/adaptor combination in accordance with the present invention comprises a socket wrench and an adaptor 40. The socket wrench includes a handle 20 having a head portion 10. The head portion 10 includes a drive column 11. In this example, the drive column 11 is square in section and has a spring-biased engaging member 12 protruding from a face thereof. A switch device 13 is mounted on the head portion 10 to allow a change in a driving direction of the socket wrench, which is conventional.

The head portion 10 is formed on an end of the handle 20. The other end of the handle 20 is an open end 21 having an engaging portion 22. In this example, the engaging portion 22 is an annular shoulder on an inner periphery defining a hole 23 of the open end 21 of the handle 20.

A coupling member 30 is engaged in the open end 21 of the handle 20 and receives the adaptor 40. Hence, the adaptor 40 is received in the handle 20 to provide a compact design without largely increasing the overall volume of the socket wrench. The coupling member 30 has an outer diameter substantially the same as an inner diameter of the open end 21 of the handle 20. In this example, the coupling member 30 includes a first end with a flange 31 having an outer diameter greater than the remaining portion of the coupling member 30. The coupling member 30 further includes a longitudinal hole 38 having a reduced section 32 in a second end thereof. The reduced section 32 is square in section and includes four walls each having a recess 33. Furthermore, the coupling member 30 includes at least one resilient tongue 34 in a peripheral wall thereof. In this example, the peripheral wall of the coupling member 30 includes a pair of substantially U-shaped slotted portions 36 to form a pair of diametrically disposed resilient tongues 34, with each resilient tongue 34 having two lateral sides facing two lateral sections of an associated U-shaped slotted portion 36, and with each resilient tongue 34 having a hook 35 on a distal end thereof.

Figure 4:
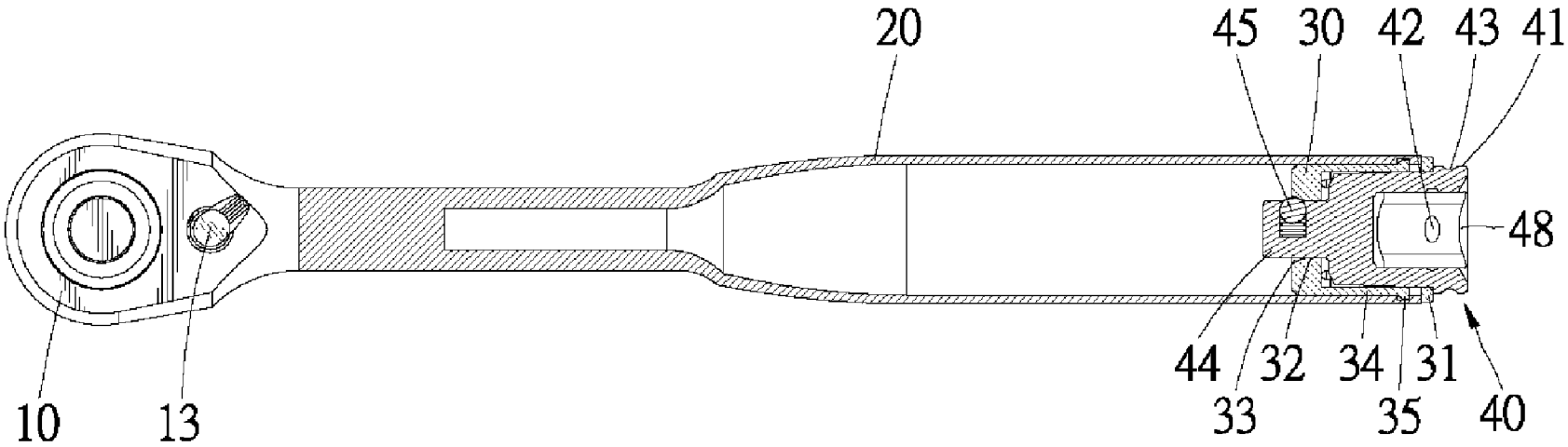
FIG. 4 is a sectional view taken along plane 4-4 in FIG. 1, illustrating engagement between the handle, the coupling member, and the adaptor of the socket wrench/adaptor combination in accordance with the present invention.

The adaptor 40 includes a coupling portion 41 on an end thereof, a drive portion 44 on the other end thereof, and an intermediate portion 46 between the coupling portion 41 and the drive portion 44. The coupling portion 41 includes a coupling groove 48 extending from an end face of the coupling portion 41 into the intermediate portion 46. The coupling groove 48 engages with the drive column 11 of the head portion 10 when the adaptor 40 is coupled with the drive column 11. The coupling groove 48 is defined by four walls each having a recess 42 for releasably engaging with the engaging member 12 of the drive column 11 of the head portion 10. The coupling portion 41 has an outer diameter greater than an outer diameter of the intermediate portion 46, which, in turn, is greater than an outer diameter of the drive portion 44. Further, the outer diameter of the coupling portion 41 is greater than a diameter of the longitudinal hole 38 of the coupling member 30. An annular groove 43 is defined in an outer periphery of the coupling portion 41 to allow easy and firm gripping by the user. In this example, the drive portion 44 of the adaptor 40 is square in section. An engaging device 45 is provided on a face of the drive portion 44 for engaging with a groove (not shown) in an end of a socket (not shown) having a size different from that of a socket (not shown) engageable with the drive column 11 of the head portion 10. Namely, the drive portion 44 of the adaptor 40 has a size different from that of the drive column 11 of the head portion 10. The engaging device 45 may include a ball (not labeled) and an elastic element (not labeled) for biasing the ball outward, as shown in FIG. 4.

When not in use, the adaptor 40 is inserted into the coupling member 30, with the intermediate portion 46 received in the longitudinal hole 38 of the coupling member 30, with the drive portion 44 extending through the reduced section 32 of the longitudinal hole 38 of the coupling member 30, with the engaging device 45 engaged with the recess 33 of one of the walls of the reduced section 32, and with the coupling portion 41 exposed outside the coupling member 30. Since each wall of the reduced section 32 has a recess 33, the adaptor 40 can be inserted through the coupling member 30 in any convenient orientation. The adaptor 40 imparts an outward expanding force to the resilient tongues 34 when the adaptor 40 is received in the longitudinal hole 38 of the coupling member 30. Hence, the resiliency of the resilient tongues 34 provides a clamping effect for retaining the adaptor 40 in place.

Figure 5:
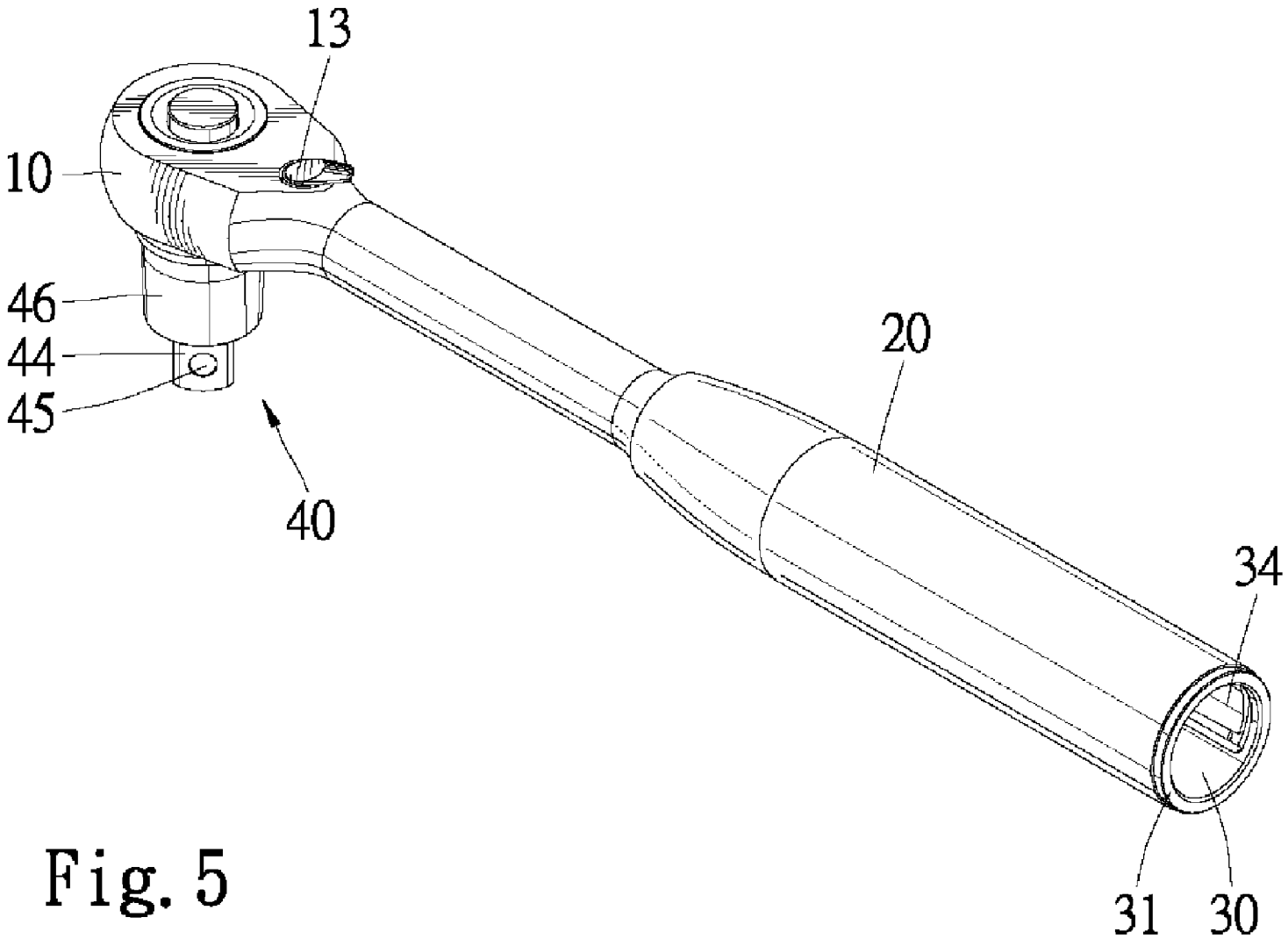
FIG. 5 is another perspective view of the socket wrench/adaptor combination in accordance with the present invention, wherein the adaptor is coupled with a drive column of a head portion of the handle.
Figure 6:
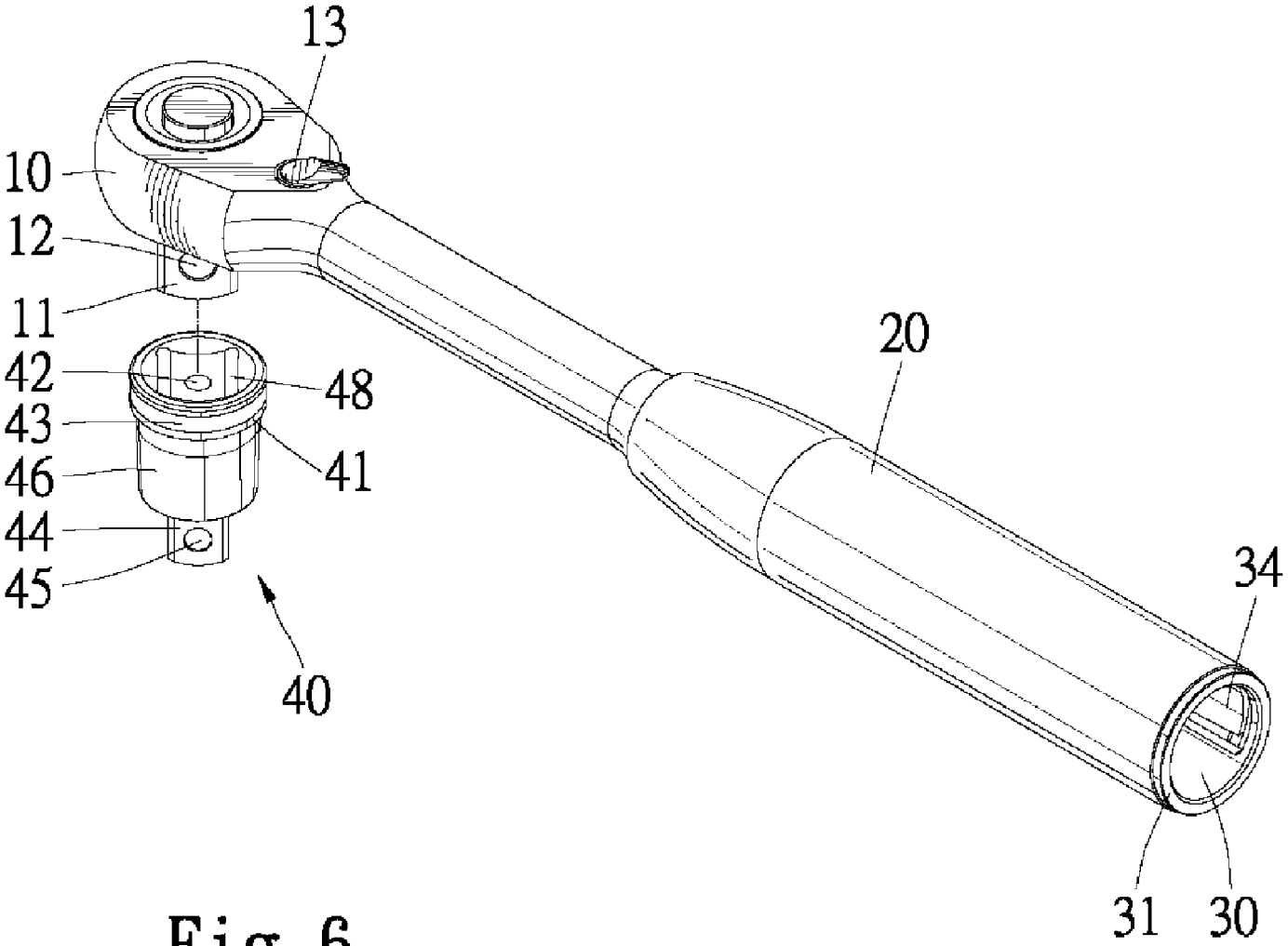
FIG. 6 is an exploded perspective view of the socket wrench/adaptor combination in FIG. 5.

FIGS. 5 and 6 show use of the adaptor 40. A user can grasp the adaptor 40 by the annular groove 43 of coupling portion 41 that has a greater outer diameter and then remove the adaptor 40 out of the coupling member 30. The coupling portion 41 of the adaptor 40 is then coupled with the drive column 11 of the socket wrench. More specifically, the drive column 11 of the socket wrench is securely engaged in the coupling groove 48, with the engaging member 48 engaged with one of the recesses 42. The drive portion 44 of the adaptor 40 has a specification different from that of the drive column 11. By this arrangement, the socket wrench in accordance with the present invention can be used with two sets of sockets of different specifications.

As apparent from the foregoing, the adaptor 40 can be received in the handle 20 of the socket wrench without the risk of loss and without largely increasing the overall volume of the socket wrench. Further, only one drive column 11 and only one switch device 13 are required. The manufacturing cost is low and storage of the socket wrench is easy. Furthermore, the socket wrench/adaptor in accordance with the present invention allows use with two sets of sockets of different specifications and, thus, can replace two conventional socket wrenches.

Although a specific embodiment has been illustrated and described, numerous modifications and variations are still possible without departing from the essence of the invention. The scope of the invention is limited by the accompanying claims.

What is claimed is:

1. A combination comprising:

a socket wrench comprising a handle including a head portion, the head portion including a drive column adapted for driving a socket, the handle including an open end;

a coupling member securely engaged in the open end of the handle; and an adaptor removably engaged with one of the drive column of the head portion and the coupling member, the adaptor including a coupling portion for releasable engagement with the drive column of the head portion, the adaptor further including a drive portion having a specification different from that of the drive column, with the drive portion being adapted for engaging with another socket having a size different from that of the socket adapted to be driven by the drive column, and with the coupling member including a longitudinal hole and a first resilient tongue, with the adaptor imparting an outward expanding force to the first resilient tongue when the adaptor is received in the longitudinal hole of the coupling member, and with the adaptor being retained in the longitudinal hole of the coupling member by resiliency of the first resilient tongue.

2. The combination as claimed in claim 1, with the coupling member including a peripheral wall having a substantially U-shaped slotted portion to form the first resilient tongue, with the first resilient tongue having two lateral sides facing two lateral sections of the substantially U-shaped slotted portion.

3. The combination as claimed in claim 1, with the open end of the handle including an engaging portion, and with the first resilient tongue including a hook engaged with the engaging portion of the handle.

4. The combination as claimed in claim 3, with the engaging portion being an annular shoulder on an inner periphery defining a hole in the open end of the handle.

5. The combination as claimed in claim 1, with the coupling member further including a second resilient member diametrically opposed to the first resilient tongue, with the adaptor imparting an outward expanding force to the second resilient tongue when the adaptor is received in the longitudinal hole of the coupling member, and with the adaptor being retained in the longitudinal hole of the coupling member by resiliency of the second resilient tongue.

6. The combination as claimed in claim 5, with the open end of the handle including an engaging portion, and with each of the first and second resilient tongues including a hook engaged with the engaging portion of the handle.

7. The combination as claimed in claim 1, with the longitudinal hole of the coupling member including a reduced section, and with the drive portion of the adaptor including an engaging device that is engaged with the reduced section when the adaptor is received in the coupling member.

8. The combination as claimed in claim 7, with the reduced section including a plurality of walls each having a recess, and with engaging device of the adaptor being releasably engaged with one of the recesses of the reduced section.

9. A combination comprising a socket wrench comprising a handle including a head portion, the head portion including a drive column adapted for driving a socket, the handle including an oven end;

a coupling member securely engaged in the open end of the handle; and an adaptor removably engaged with one of the drive column of the head portion and the coupling member, the adaptor including a coupling portion for releasable engagement with the drive column of the head portion, the adaptor further including a drive portion having a specification different from that of the drive column, with the drive portion being adapted for engaging with another socket having a size different from that of the socket adapted to be driven by the drive column, and with the coupling member including a flange having an outer diameter greater than that of the open end of the handle, and with the flange abutting against an end face of the open end of the handle.

10. A combination comprising a socket wrench comprising a handle including a head portion, the head portion including a drive column adapted for driving a socket, the handle including an open end;

a coupling member securely engaged in the open end of the handle; and an adaptor removably engaged with one of the drive column of the head portion and the coupling member, the adaptor including a coupling portion for releasable engagement with the drive column of the head portion, the adaptor further including a drive portion having a specification different from that of the drive column, with the drive portion being adapted for engaging with another socket having a size different from that of the socket adapted to be driven by the drive column, and with the coupling portion of the adaptor being exposed outside the coupling member when the adaptor is received in the coupling member.

11. The combination as claimed in claim 10, with the coupling portion of the adaptor including an annular groove in an outer periphery thereof.

12. A combination comprising a socket wrench comprising a handle including a head portion, the head portion including a drive column adapted for driving a socket, the handle including an open end;

a coupling member securely engaged in the open end of the handle; and an adaptor removably engaged with one of the drive column of the head portion and the coupling member, the adaptor including a coupling portion for releasable engagement with the drive column of the head portion, the adaptor further including a drive portion having a specification different from that of the drive column, with the drive portion being adapted for engaging with another socket having a size different from that of the socket adapted to be driven by the drive column, and with the coupling member including a Longitudinal hole having a reduced section, with the adaptor further including an intermediate portion between the coupling portion and the drive portion, with the intermediate portion being received in the longitudinal hole, with the drive portion extending through the reduced section, and with the coupling portion exposed outside the coupling member when the adaptor is received in the coupling member, with the drive portion of the adaptor further including an engaging device for releasably engaging with the other socket, and with the reduced section including a plurality of walls each having a recess, and with the engaging device of the adaptor being releasably engaged with one of the recesses of the reduced section.

13. The combination as claimed in claim 12, with the coupling member further including a first resilient tongue, with the adaptor imparting an outward expanding force to the first resilient tongue when the adaptor is received in the longitudinal hole of the coupling member, and with the adaptor being retained in the longitudinal hole of the coupling member by resiliency of the first resilient tongue.

14. The combination as claimed in claim 13, with the coupling member including a peripheral wall having a substantially U-shaped slotted portion to form the first resilient tongue, with the first resilient tongue having two lateral sides facing two lateral sections of the substantially U-shaped slotted portion.

15. The combination as claimed in claim 13, with the open end of the handle including an engaging portion, and with the first resilient tongue including a hook engaged with the engaging portion of the handle.

16. The combination as claimed in claim 15, with the engaging portion being an annular shoulder on an inner periphery defining a hole in the open end of the handle.

17. The combination as claimed in claim 13, with the coupling member further including a second resilient member diametrically opposed to the first resilient tongue, with the adaptor imparting an outward expanding force to the second resilient tongue when the adaptor is received in the longitudinal hole of the coupling member, and with the adaptor being retained in the longitudinal hole of the coupling member by resiliency of the second resilient tongue.

18. The combination as claimed in claim 17, with the open end of the handle including an engaging portion, and with each of the first and second resilient tongues including a hook engaged with the engaging portion of the handle.

19. The combination as claimed in claim 18, with the engaging portion being an annular shoulder on an inner periphery defining a hole in the open end of the handle.

* * * * *